US005142467A

United States Patent [19]

Yuen

[11] Patent Number: 5,142,467

[45] Date of Patent: Aug. 25, 1992

[54] HAND HELD SPOTLIGHT WITH TRIPOD HANDLE

[75] Inventor: Choi T. Yuen, Kowloon, Hong Kong

[73] Assignee: Chiat Si Industrial Company, Ltd., Kowloon, Hong Kong

[21] Appl. No.: 789,328

[22] Filed: Nov. 8, 1991

[51] Int. Cl.[5] ..... F21L 15/12

[52] U.S. Cl. ..... 362/399; 362/418; 362/427

[58] Field of Search ..... 362/190, 191, 388, 399, 362/413, 414, 418, 427

[56] References Cited

U.S. PATENT DOCUMENTS

| | | | |
|---|---|---|---|
| 1,481,998 | 1/1924 | Eldredge | 362/418 |
| 2,237,202 | 4/1941 | Strattan | 362/413 |
| 2,237,536 | 4/1941 | Wells, Jr. | 362/190 |
| 2,706,610 | 4/1955 | Roberts | 362/191 |
| 2,732,543 | 1/1956 | Mogren | 362/190 |
| 3,160,755 | 12/1964 | Wolfe | 362/413 |
| 3,415,476 | 12/1968 | McDermott | 362/190 |

*Primary Examiner*—Allen M. Ostrager
*Assistant Examiner*—Alan B. Cariaso
*Attorney, Agent, or Firm*—Hovey, Williams, Timmons & Collins

[57] ABSTRACT

A spotlight apparatus includes a lamp and a support assembly coupled with the lamp. The support assembly includes support elements shiftable between a support position in which the lower ends of the elements are shifted outwardly to form a tripod, and a handle position in which the elements are shifted inwardly and the exterior surfaces thereof cooperatively form a continuous handle surface for grasping.

5 Claims, 2 Drawing Sheets

HAND HELD SPOTLIGHT WITH TRIPOD HANDLE

BACKGROUND OF THE INVENTION

1. Field of the Invention

The present invention concerns a spotlight apparatus including a lamp and a support assembly having support elements which shift outwardly to form a tripod and which shift inwardly to form a handle presenting a continuous grasping surface.

2. Description of the Prior Art

Portable spotlights in the prior art typically include a handle for grasping by the user and may be battery powered or may include a power cord for connecting to a source of power. The utility of these types of prior art spotlights is limited, however, in that they are not self supporting. That is to say, such spotlights cannot be placed on a support surface for directing the beam in a desired direction. Other prior art spotlights can be coupled with a tripod, such as that used for cameras or surveying equipment, but such tripods are bulky and inconvenient to use.

SUMMARY OF THE INVENTION

The spotlight apparatus of the present invention solves the prior art problems discussed above and provides a distinct advance in the state of the art. More particularly, the invention hereof provides a graspable handle presenting a substantially continuous surface which conveniently converts to a tripod.

Broadly, the spotlight apparatus includes a lamp operable for emanating a directional beam and an elongated support assembly coupled with the lamp for directing the beam in a direction generally transverse to the assembly. The preferred assembly includes a plurality of support elements with the upper ends thereof pivotally coupled for shifting of the elements between support and handle positions. In the support position, the lower ends of the elements are shifted outwardly and cooperate to form a base in order to support the apparatus on the support surface. In the handle position, the elements are shifted inwardly whereby the exterior surfaces of the elements cooperatively form a substantially continuous, graspable, handle surface. The preferred aspects of the invention are discussed hereinbelow.

DETAILED DESCRIPTION OF THE PREFERRED EMBODIMENT

Figure 1:
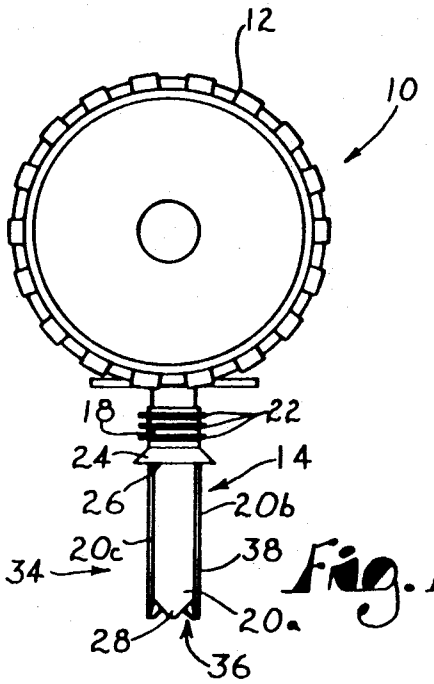
FIG. 1 is a front view of the spotlight apparatus of the present invention showing the support elements in the handle position.
Figure 2:
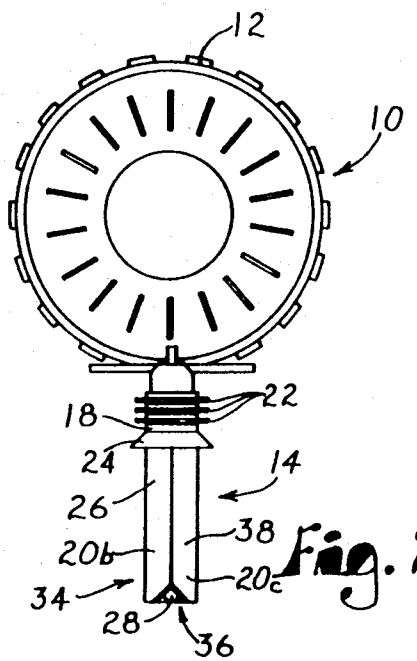
FIG. 2 is a rear view of the apparatus of FIG. 1.
Figure 3:
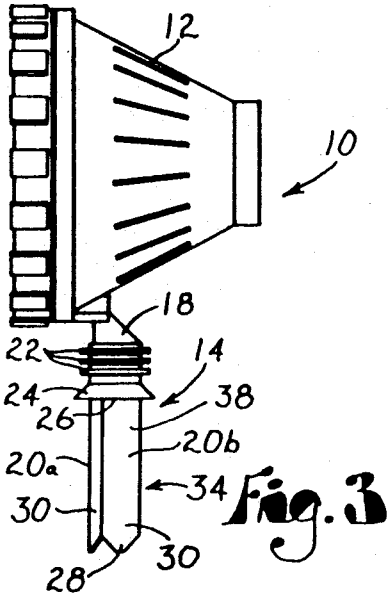
FIG. 3 is a left side view of the apparatus of FIG. 1.
Figure 4:
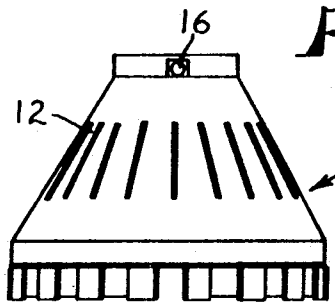
FIG. 4 is a top plan view of the apparatus of FIG. 1.

The drawing figures illustrate preferred spotlight apparatus 10 which broadly includes lamp 12 and support assembly 14.

Lamp 12 is a conventional high intensity, electrically powered lamp which emanates a highly directional beam in the nature of a spotlight. Preferably, lamp 12 is battery powered with rechargeable batteries, but in the alternative, can be powered from a remote power source by use of a power cord (not shown) plugged into receptacle 16.

Support assembly 14 includes upper, stationery portion 18 and support elements 20*a*, 20*b* and 20*c*. Support assembly 14 is integrally formed of synthetic resin material such as high strength plastic. The upper end of portion 18 is coupled with lamp 12 so that the beam emanating from lamp 12 is directed generally transverse to assembly 14. Stationery portion 18 includes fins 22 and frusto-conically shaped hand stop 24 adjacent the lower end thereof.

Support elements 20*a,b,c* are preferably formed of high strength synthetic resin material. Each element 20*a,b,c* presents an arc of 120° in transverse cross section and includes upper and lower ends 26 and 28 respectively, exterior surfaces 30, and side edges 32. Upper ends 26 are pivotally coupled with upper portion 18 adjacent hand stop 24 in an equi-angular relationship thereabout.

Figure 5:
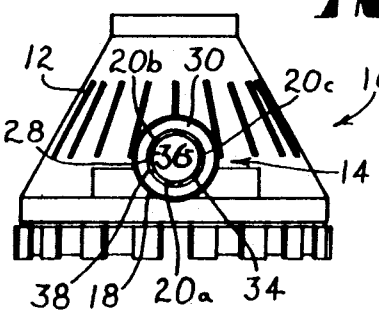
FIG. 5 is a bottom plan view of the apparatus of FIG. 1.
Figure 6:
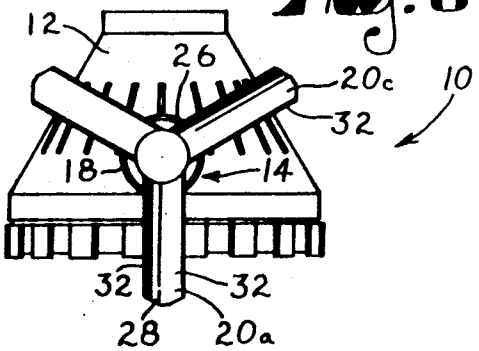
FIG. 6 is a bottom plan view of the apparatus showing the support elements in the support position.
Figure 9:
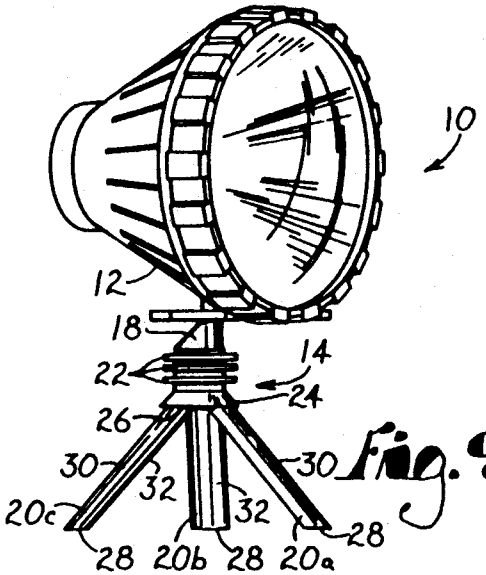
FIG. 9 is a right frontal perspective view of the apparatus in FIG. 6.
Figure 8:
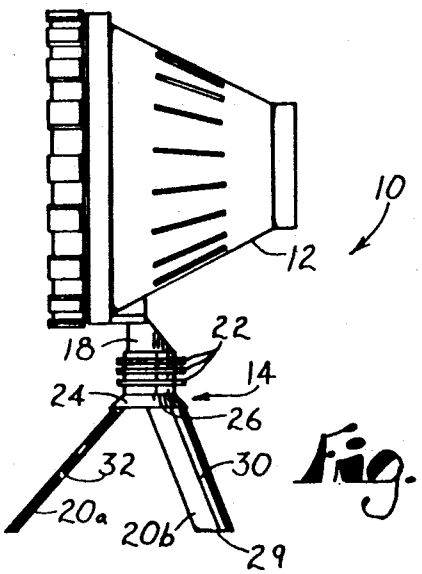
FIG. 8 is a left side view of the apparatus in FIG. 6.
Figure 7:
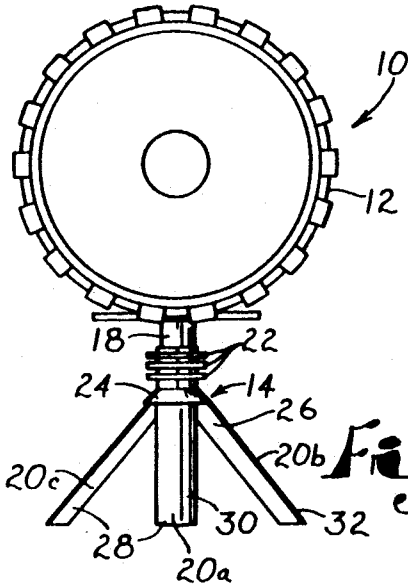
FIG. 7 is a front view of the apparatus in FIG. 6.

Elements 20*a,b,c* are shiftable between a handle forming position illustrated in FIGS. 1–3 and 5, and a support position illustrated in FIGS. 6–9. In the handle position, side edges 32 of each of elements 20*a,b,c* matingly engage a corresponding adjacent side edge so that elements 20*a,b,c* cooperate to form handle 34 which presents a circular shape in transverse cross section as best shown in FIG. 5. With handle 34 so formed, storage chamber 36 is defined thereby which can be used for storing a power cord, for example.

In the handle position, exterior surfaces 30 of each of elements 20*a,b,c* cooperatively form a substantially continuous handle surface 38 extending around handle 34. The dimensions of elements 20*a,b,c* are such that handle 34 can be firmly and comfortably grasped with the upper portion of the user's hand abutting hand stop 24. In this way, the user can effectively direct the beam emanating from lamp 12 to the desired location.

FIGS. 6–9 illustrate elements 20*a,b,c* in the support position in which equally spaced lower ends 28 are shifted outwardly and cooperatively form a base, that is, a tripod for supporting apparatus 10 on a support surface.

As those skilled in the art will appreciate, the present invention encompasses many variations in the preferred embodiment described herein.

Having thus described the preferred embodiment of the present invention the following described as new and desired to be secured by Letters Patent I claim:

1. A spotlight apparatus having combined self supporting and a hand-grasping capability, said apparatus comprising:

a lamp operable for emanating a directional beam; and an elongated support assembly coupled with said lamp for directing said beam in a generally transverse direction relative to said assembly, said assembly including a plurality of elongated support elements presenting respective upper and lower ends and exterior surfaces, and coupling means pivotally coupling said upper ends adjacent one another in a non-spaced relationship for selective shifting of said elements between a support position in which said lower ends are pivoted outwardly into a spaced relationship and cooperatively form a base for supporting said apparatus on a support surface, and a handle position in which said lower ends are shifted inwardly into a juxtaposed relationship so that said support elements cooperate to form a handle, and in which said exterior surfaces cooperatively form a continuous, graspable handle surface extending around said handle, each of said elements presenting opposed side surfaces with each side surface configured to matingly engage a corresponding side surface of an adjacent support element when in said handle position without a gap therebetween, and presenting an arch shaped configuration in transverse cross section sufficient cooperatively forming said handle to present a generally circular configuration in transverse cross section and for defining an elongated storage chamber within said handle with said chamber presenting an open end adjacent said lower ends.

2. The apparatus as set forth in claim 1, said elements being formed of synthetic resin material.

3. The apparatus as set forth in claim 1, support elements being coupled in an equi-angular relationship.

4. The apparatus as set forth in claim 1 including three of said support elements for forming a tripod in said support position.

5. The apparatus as set forth in claim 1, said assembly further including a handstop adjacent said upper ends for engaging the upper portion of a user's hand when grasping said handle.

* * * * *